US005836124A

United States Patent [19]

Aspehaug et al.

[11] Patent Number: 5,836,124

[45] Date of Patent: Nov. 17, 1998

[54] FOUNDATION TUBE FOR USE AS A FOUNDATION FOR MASTS, POSTS, PILLARS, ETC.

[75] Inventors: Nils Aspehaug, Billingstad; Frode Inge Volle, Nesøya, both of Norway

[73] Assignee: Kvaerner Eureka a.s., Lier, Norway

[21] Appl. No.: 704,512

[22] PCT Filed: Mar. 13, 1995

[86] PCT No.: PCT/NO95/00055

§ 371 Date: Sep. 12, 1996

§ 102(e) Date: Sep. 12, 1996

[87] PCT Pub. No.: WO95/25213

PCT Pub. Date: Sep. 21, 1995

[30] Foreign Application Priority Data

Mar. 14, 1994 [NO] Norway ..... 940911

[51] Int. Cl.[6] ..... E02D 27/32

[52] U.S. Cl. ..... 52/297; 52/298; 405/236; 405/239; 427/239; 118/404

[58] Field of Search ..... 52/298, 296, 297, 52/294, 742.14, 741.14; 405/236, 233, 239, 241; 118/708, 105, 404; 427/239, 156, 155, 207.1, 289

[56] References Cited

U.S. PATENT DOCUMENTS

| | | | |
|---|---|---|---|
| 3,544,110 | 12/1970 | Dickinson | 52/297 |
| 4,125,975 | 11/1978 | Soble | 52/297 X |
| 4,328,267 | 5/1982 | Matsuo et al. | 118/404 X |
| 4,474,243 | 10/1984 | Gaines | 405/236 X |
| 5,147,847 | 9/1992 | Yamazaki | 427/239 X |
| 5,259,702 | 11/1993 | Simpson | 405/236 X |
| 5,355,642 | 10/1994 | Palamarz | 52/297 X |
| 5,460,852 | 10/1995 | Janicki et al. | 427/239 X |
| 5,472,296 | 12/1995 | Von Allimen et al. | 405/239 X |

*Primary Examiner*—Wynn E. Wood
*Assistant Examiner*—W. Glenn Edwards
*Attorney, Agent, or Firm*—Browdy and Neimark

[57] ABSTRACT

A foundation for masts, posts, pillars, etc., wherein the foundation has a foundation tube (3) which is lowered into a pre-drilled hole (2) in the ground (1), where the pre-drilled hole has a diameter larger than the diameter of the tube (3) and where at least the space between tube (3) and ground (1) is filled with a casting mixture (8), e.g. concrete, a tube (3) is used which is designed with perforations (4) in its lower area. The foundation tube (3) is equipped with a coating which gives the tube protection against corrosion, and possibly also an electrical insulation. The coatings can have a rough surface in order to create the best possible adhesion to the casting mixture. In order to ensure that the coated foundation tube (3) is safely lowered into the hole, it is first lined with a casing (13), which is removed during or immediately after the casting.

4 Claims, 2 Drawing Sheets

FOUNDATION TUBE FOR USE AS A FOUNDATION FOR MASTS, POSTS, PILLARS, ETC.

The invention concerns a foundation tube for use as a foundation for masts posts, pillars, etc., wherein perforations or holes are provided in the tube for forcing casting mixture out into the space between the tube and the surrounding substance. The invention also concerns a method for formation of a foundation for masts, posts, etc. comprising at least one foundation tube which is lowered into a pre-drilled hole in the ground, the hole having a diameter greater than the diameter of the tube and where at least the space between the tube and the ground is filled with a casting mixture, e.g. concrete.

A number of different methods are known for manufacturing mast foundations by driving tubes down into the ground, wherein the tubes are filled with concrete and cast in position to form the finished foundation. It is also known in the prior art for such tubes to be equipped with perforations in order to force the concrete out through the tube and into the ground surrounding the tube. In this connection it is also a known procedure to first drill a hole in the ground and then place a perforated tube in the hole, whereupon the tube is cast in position, as the casting mixture is forced out through the perforations, filling the space between the hole and the ground as well as the actual tube. The upper part of the tube is equipped with fastening devices for a pillar, mast or other equipment which has to be secured to the foundation. A plurality of such tubes can also be used jointly for a larger foundation and connected to one another by means of a top plate.

This method of laying a foundation has proved to be very practical, but nevertheless there has been a need for a further improvement of the method.

One of the problems which are encountered in laying a foundation is that in many places there is an extremely corrosive environment at the foundation location, both above the ground and in the ground itself, and this can affect the tube foundation, giving it a very short working life.

Another problem is that in the case of masts, posts, etc. which support live wires or cables, a flashover can easily occur in the foundation, which is considered to be a disadvantage, particularly if this occurs at ground level.

Thus it is an object of the present invention to provide a foundation tube wherein the problems of corrosion are avoided and wherein the foundation tube is designed in such a manner that it can be securely attached to the ground. A further object of the invention is to provide an improved method of laying a foundation, whereby the problems described in the introduction can be remedied to the greatest possible extent, thus enabling an efficient and satisfactory method to be achieved of laying a foundation for masts, posts, etc.

It is also an object of the invention to avoid the formation of electrical bridges between the foundations and post and ground level.

These objects are achieved with a foundation tube of the type mentioned in the introduction, which is characterized by those features indicated in the patent claims. The invention also concerns a method for the formation of a foundation, and the method is characterized by the features indicated in the patent claims.

By providing the foundation tube with an external and internal coating, especially of thermoplastic, the foundation tube is very well protected against corrosive influences. By equipping the coating with a rough surface, a particularly secure attachment is ensured during casting. Thus the foundation tube according to the invention will have a long working life even in an extremely corrosive environment.

When laying a foundation for current-carrying pylons, a corrosion coating also provides an insulating effect. This insulation may be achieved with an extra coating on a clean corrosion coating. On the bottom part of the foundation tube it is advantageous to also provide a coating with a rough surface in order to give the best possible adhesion to the casting mixture. The outermost coating, either the corrosion coating or possibly the insulating coating, can also have a rough surface in order to achieve a similar effect. Suitable coatings providing a rough surface or coating additives may include quartz sand.

The use of thermoplastics is preferred as a coating material, and a particularly advantageous thermoplastic is EVO (ethylenevinylalcoholcopolymer).

According to the invention, a casing is used in the method for laying a foundation. This is very important when a foundation tube which is coated on the outside has to be lowered into the pre-drilled hole. In a normal pre-drilled hole there would be a great risk of the coating being damaged during the lowering operation. A further advantage of using a casing is that a collapse of loose material is avoided, thus giving satisfactory control of the pre-drilled hole and its subsequent filling with casting mixture.

The invention will now be explained in more detail by means of an embodiment which is illustrated in the drawing, in which.

Figure 1:
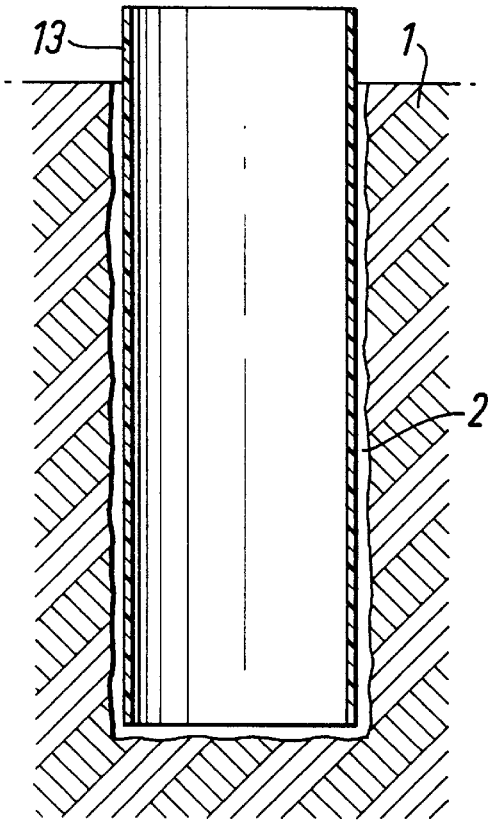
FIG. 1 is a schematic view of a pre-drilled hole with casing inserted.

The drawing illustrates only the principle of the invention, and dimensions of holes and the various tubes are not on the correct scale and are not intended to illustrate the concept of the invention.

In the method according to the invention a foundation will be manufactured by lowering a foundation tube 3 into the ground 1. A hole 2 is drilled in the ground beforehand, which can have a larger diameter than the diameter of the foundation tube. As illustrated in FIG. 1, a casing 13 is first lowered into the pre-drilled hole. This casing 13 should have a diameter which is relatively close to the diameter of the hole, and still be easy to insert. The casing can be of any material whatever, e.g. a plastic tube, since the tube is intended to be pulled up during the casting process. After the casing 13 has been lowered into the hole, the hole has an even cylindrical outer wall and a foundation tube can be lowered without the risk of damaging any coating on the tube.

Figure 2:
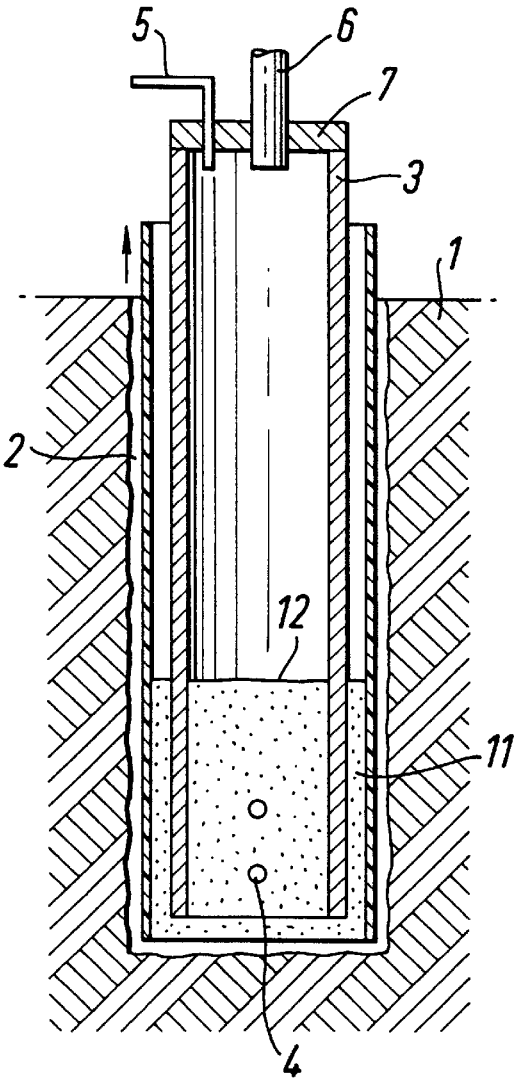
FIG. 2 is a schematic view of a foundation tube which has been lowered into the pre-drilled hole with casing, casting mixture or grouting material having been supplied before filling the hole.
Figure 3:
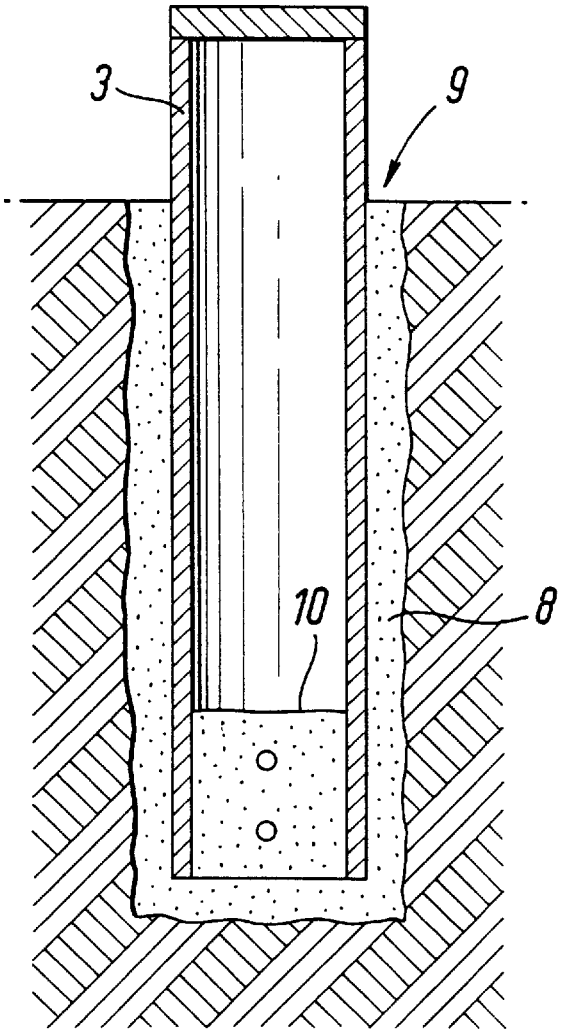
FIG. 3 is a completed foundation manufactured in accordance with the method according to the invention.

As illustrated in FIG. 2 a foundation tube 3 is lowered into the hole 2 and its upper part closed by a cap 7 through which a tube 5 is passed for connection to a compressed air source (not shown) and a lead-in tube 6 for casting mixture. In the bottom part of the foundation tube there are provided perforations 4. For casting of the foundation tube, a casting mixture which may be, e.g. concrete, is filled through the tube 6, the tube being filled with a predetermined amount, e.g. until the mixture reaches a level which is indicated by 12 in FIG. 2. Compressed air is then supplied through the tube 5 above the casting mixture 11 in the tube 13, causing it to be forced out through the holes 4 and to fill up the space between the tube 3 and the ground 1. At the same time as the space is being filled, the casing 13 is pulled up. Alternatively, one can wait until the space is filled before pulling up the casing. When the casting mixture reaches the surface of the ground, the application of pressure in the space 9 is stopped and the entire space 2 is thereby filled with casting mixture 8 as illustrated in FIG. 3. The casting mixture inside the tube is then lowered to a level 10 which is directly above the holes 4. In this manner the foundation tube 3 is cast in position without being filled with casting mixture apart from the bottom part which covers the perforations 4. A minimum of casting mixture is thereby employed and in this manner it will be possible to adjust the rigidity of the foundation, according to the filling level.

If an insufficient amount of casting mixture has been poured into the tube at the beginning of the casting process, the compressed air will force all the casting mixture out of the tube and compressed air will be forced out into the space 2 and "bubble up" to the surface. It will be registered as a drop in pressure, which gives a clear indication that too little casting mixture has been used. In this case the only action required is to supply an extra amount of casting mixture through the supply tube 6, thus allowing the process to continue and pressure to be re-established.

Figure 4:
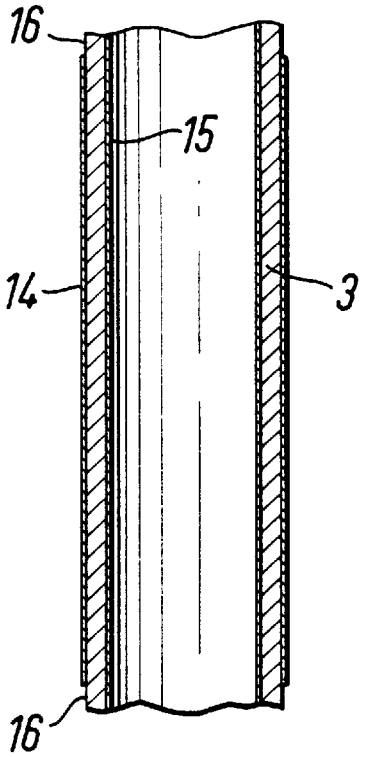
FIG. 4 is a section of a foundation tube according to the invention.

In order to obtain a mast or post foundation with the longest possible working life, tubes are used which are coated with corrosion-resistant coating 14, 15 both on the inside and the outside. These coatings are shown in FIG. 4. Such coatings 14, 15 can be applied by means of known per se methods such as sintering. It is an advantage if the corrosion coating is also insulating. A further insulating coating (not shown) can be applied on top of the corrosion coating. This is particularly advantageous in the case of a mast foundation which is intended for pylons or posts which support live wires or cables. In such cases it is also desirable to provide an earth, this being easily achieved by removing the insulating coating at the bottom and top of the foundation tube at 16 and 17, thus enabling a contact to be established through the tube from the surface of the around to the deepest point in the foundation. 5 In order to ensure the best possible adhesion to the casting mixture, the surfaces of the coating are preferably rough, or an extra coating can be applied particularly in the lower part of the tube which Lives the tube a rough surface with a good adhesion to the casting mixture. This coating too is not illustrated in the drawing.

By means of the invention, therefore, a foundation can be provided which can be lowered in a minimum of time by pre-drilling a hole, the hole being lined with the casing 13, and the foundation tube can be put into position very quickly and in a very simple manner with minimum risk of damage to the tube, or its coating.

By filling only a limited amount of the casting mixture, a saving can thereby also be made in the amount of casting mixture, which is an advantage if the mixtures are used in inaccessible locations. The restriction of the amount of casting mixture does not affect the quality of the actual casting, since adequate control has been provided for ensuring that the entire space between the tube and the surrounding earth has been filled. Thus the method according to the invention is a reliable and rapid method of providing foundations. while at the same time the tubes used are given a very advantageous design which provides additional advantages, e.g. electrical insulation and an earthing rod.

In this connection it should be pointed out that problems will arise of destruction of the coatings if tubes with coating on the outside are driven down according to conventional methods, where the tubes themselves establish the hole when being driven into the ground, or where coated tubes are lowered into narrow pre-drilled holes.

When pre-drilling the hole in the ground, as an alternative the casing can also be lowered into the hole with the drill head, thus immediately providing a protection against the earth on the outside and keeping it in place. The drill head is therefore designed in such a manner that it can be pulled up through the casing. There are many possible alternatives here. The use of such casings is particularly advantageous in those cases where the soil may contain projecting stones and the like which can damage the coatings when the foundation tube is lowered.

Thus the invention enables tubes which are equipped with a coating to be safely lowered.

We claim:

1. A foundation tube (3) for use as foundation for masts, posts, pillars, etc., wherein perforations or holes (4) are provided for casting mixture (8) in the space between the tube (3) and the surrounding material (1), characterized in that the tube (3) is coated internally and externally along its entire length with an electrically insulating, covering coating (14, 15), especially of thermoplastic, that in addition to a covering coating (14, 15) both internally and externally, an electrically insulating coating is applied, and that lower part (16) of the tube (3) internally and externally is given a rough surface, which provides a secure attachment to the casting mixture (8), and a roughness-forming coating is provided on the outside, especially at the lower part (16) of the tube (3), wherein the electrically insulating coating (14) is removed in a top part and the bottom part (16) of the tube (3).

2. A foundation tube according to claim 1, characterized in that a stocking is shrunk on to the foundation tube (3).

3. A method for formation of a foundation for masts, posts, pillars, etc., comprising a foundation tube (3) which is lowered into a pre-drilled hole (2) in the ground, where the hole (2) has a diameter larger than the diameter of the tube (3), wherein the foundation tube comprises an electrically insulating coating (14) removed in a top part and a bottom part (16) of the tube (3) and where at least the space between the tube (3) and the surrounding material (1) is filled with a casting mixture (8), concrete, characterized in that a casing (13) is inserted into the pre-drilled hole (2), and that a foundation tube (3) equipped with the coating (14, 15) is inserted into the casing (13), whereupon the casing (13) is pulled up, at the same time as the casting of the hole.

4. A method according to claim 3, characterized in that the casing (13) is inserted into the hole (2) at the same time as the hole (2) is drilled.

* * * * *